US007056420B2

(12) United States Patent
Salmela

(10) Patent No.: US 7,056,420 B2
(45) Date of Patent: Jun. 6, 2006

(54) METHOD IN LEADING A WEB THREADING TAIL PARTICULARLY IN A PAPER MACHINE

(75) Inventor: Juha Salmela, Tavastila (FI)

(73) Assignee: Metso Paper, Inc., Helsinki (FI)

( * ) Notice: Subject to any disclaimer, the term of this patent is extended or adjusted under 35 U.S.C. 154(b) by 301 days.

(21) Appl. No.: 10/358,449

(22) Filed: Feb. 3, 2003

(65) Prior Publication Data

US 2003/0159789 A1 Aug. 28, 2003

(30) Foreign Application Priority Data

Feb. 25, 2002 (FI) ..... 20025007

(51) Int. Cl.
*D21F 1/36* (2006.01)
*G03B 1/56* (2006.01)

(52) U.S. Cl. ..... 162/193; 226/7

(58) Field of Classification Search ..... 162/193; 226/7, 91–92; 34/117
See application file for complete search history.

(56) References Cited

U.S. PATENT DOCUMENTS 3,999,696 A * 12/1976 Reba et al. ..... 226/7
4,014,487 A * 3/1977 Reba et al. ..... 226/5
4,684,443 A 8/1987 Kerttula et al.
4,854,053 A * 8/1989 Skaugen ..... 34/117
4,904,344 A * 2/1990 Peiffer ..... 162/193
4,923,567 A * 5/1990 Liedes et al. ..... 162/193
4,997,524 A * 3/1991 Nieminen et al. ..... 162/193
5,037,509 A * 8/1991 Wedel ..... 162/193
5,379,526 A * 1/1995 Haverinen ..... 34/114
5,762,759 A * 6/1998 Wedel ..... 162/193
6,022,452 A * 2/2000 Caspar ..... 162/286
6,073,825 A * 6/2000 Hilker ..... 226/91
6,131,784 A * 10/2000 Helgesson et al. ..... 226/91
2003/0111199 A1* 6/2003 Clake et al. ..... 162/193
2003/0159789 A1* 8/2003 Salmela ..... 162/193
2003/0183353 A1* 10/2003 Helgesson et al. ..... 162/191
2004/0256434 A1* 12/2004 Broom ..... 226/1

* cited by examiner

*Primary Examiner*—José A. Fortuna
(74) *Attorney, Agent, or Firm*—Fildes & Outland, P.C.

(57) ABSTRACT

The invention relates to a method in leading a web threading tail particularly in a paper machine. In the method a device is used, which is moved close to a fabric transporting the web threading tail and by means of which the web threading tail is detached from the surface of the fabric. The web threading tail is transferred laterally relative to its direction of travel to the following web threading device, after which the device is moved away from the vicinity of the web threading tail. The transfer of the web threading tail in the cross direction of the paper machine takes place mechanically by pushing. The invention also related to a corresponding device.

3 Claims, 6 Drawing Sheets

METHOD IN LEADING A WEB THREADING TAIL PARTICULARLY IN A PAPER MACHINE

FIELD OF THE INVENTION

The present invention relates to a method in leading a web threading tail particularly in a paper machine, in which method a device arranged attached to the frame structure of the paper machine is used, which device is moved close to the fabric transporting the web threading tail and by means of which the web threading tail is detached from the surface of the fabric and transferred laterally relative to the direction of travel of the web threading tail to the following web threading device, after which the device is moved away from the vicinity of the web threading tail. The invention also relates to a corresponding device.

BACKGROUND OF THE INVENTION

The construction depicted in the introduction is very common, particularly in paper machines, especially between the press section and the drying section of the paper machine. In this position, it is usual to lead the web threading tail in a specific way. In practice, in the beginning of the tail threading, the web threading tail is led in a known way from the press section on the surface of the fabric to the first drying cylinder and from there down to a pulper. Once the movement of the web threading tail has settled, the web threading tail is transferred in the cross direction of the paper machine to the web threading device of the drying section, which takes the web threading tail through the drying section. The two-stage operation is used in an attempt to avoid web breaks in the press section caused by tail threading, in which press section the tail threading is laborious.

At its simplest, an operator detaches the web threading tail from the surface of the fabric and transfers it laterally by hand, so that the web threading tail, which is moving forward the whole time, travels on to the next web threading device. Generally, the web threading device in question is a totality formed of ropeways, with the web threading tail being transferred to the rope throat that this forms. Usually, at least one ropeway is between the fabric and the operator, so that the operator's hand is always in danger of striking the rope of the ropeway. The situation is further aggravated by the cramped space and poor visibility. Additional major safety risks are the large rotating machine parts, the rapidly moving fabric, and especially the ropeways.

In order to avoid manual transfer, devices have been developed that would allow the web threading tail to be transferred laterally. One such device is disclosed in U.S. Pat. No. 4,542,160, in which two blower elements are used in combination. An improvement of the said device is disclosed in U.S. Pat. No. 4,784,443. In both applications, the first blower element is used to detach the web threading tail from the surface of the fabric. Similarly, the second blower element is used to create a blast essentially in the cross direction of the paper machine, and which is used to move the web threading tail laterally. However, the blower elements are at least partly in the area of travel of the web and are thus liable to be broken. In addition, they collect loose material on top of themselves. Further, the blasts are also difficult to control and their operation is otherwise imprecise. In other words, the use of blasts to transfer the web threading tail is imprecise and uncertain. In addition, the blasts are only suitable for pulp webs with a low grammage.

SUMMARY OF THE INVENTION

The invention is intended to create a new type of method for leading a web threading tail particularly in a paper machine, by means of which the leading of the web threading tail will be more certain and simpler than before. The invention is also intended to create a new type of device for corresponding use, which has a durable construction and which is easy to apply and adjust.

The method in leading a web threading tail in a paper machine, in which method a device arranged attached to the frame structure of the paper machine is used, which is moved close to the fabric transporting the web threading tail and by which the web threading tail is detached from the surface of the fabric and transferred relative to the direction of travel of the web threading tail to the following web threading device, after which the device is moved away from the vicinity of the web threading tail, is characterized in that the transfer of the web threading tail in the cross direction of the paper machine is made mechanically by pushing.

Correspondingly, the device in leading a web threading tail in a paper machine, which device is intended to be located attached to the frame structure of the paper machine, in connection with the fabric transporting the web threading tail and which includes a blower device for detaching the web threading tail from the surface of the fabric and a transfer device for transferring the detached web threading device laterally relative to the direction of travel of the web threading tail to the following web threading device, is characterized in that the transfer device is formed as a transfer member to be moved essentially in the cross direction of the paper machine, and which is arranged to mechanically push the web threading tail and in which the said blower device is arranged.

In the method according to the invention, the transfer of the web threading tail is arranged to take place in stages and in a straight line. The method is thus easy to implement and repeat. In addition, the transfer of the web threading tail is controlled, which considerably reduces the risk of failure. The device according to the invention is suitable for use with all kinds of web threading tails. During the transfer, the web threading tail is continuously precisely controlled, which does not, however interfere with the movement of the web threading tail. In addition, the device can be located even in a cramped position and can be simply moved away from the vicinity of the web threading devices and fabric after tail threading. It is also simple to adjust the device precisely to the desired position while retaining its settings, irrespective of use or operating conditions.

These and other features and advantages of the invention will be more fully understood from the following detailed description of the invention taken together with the accompanying drawings.

DETAILED DESCRIPTION OF THE INVENTION

Figure 1:
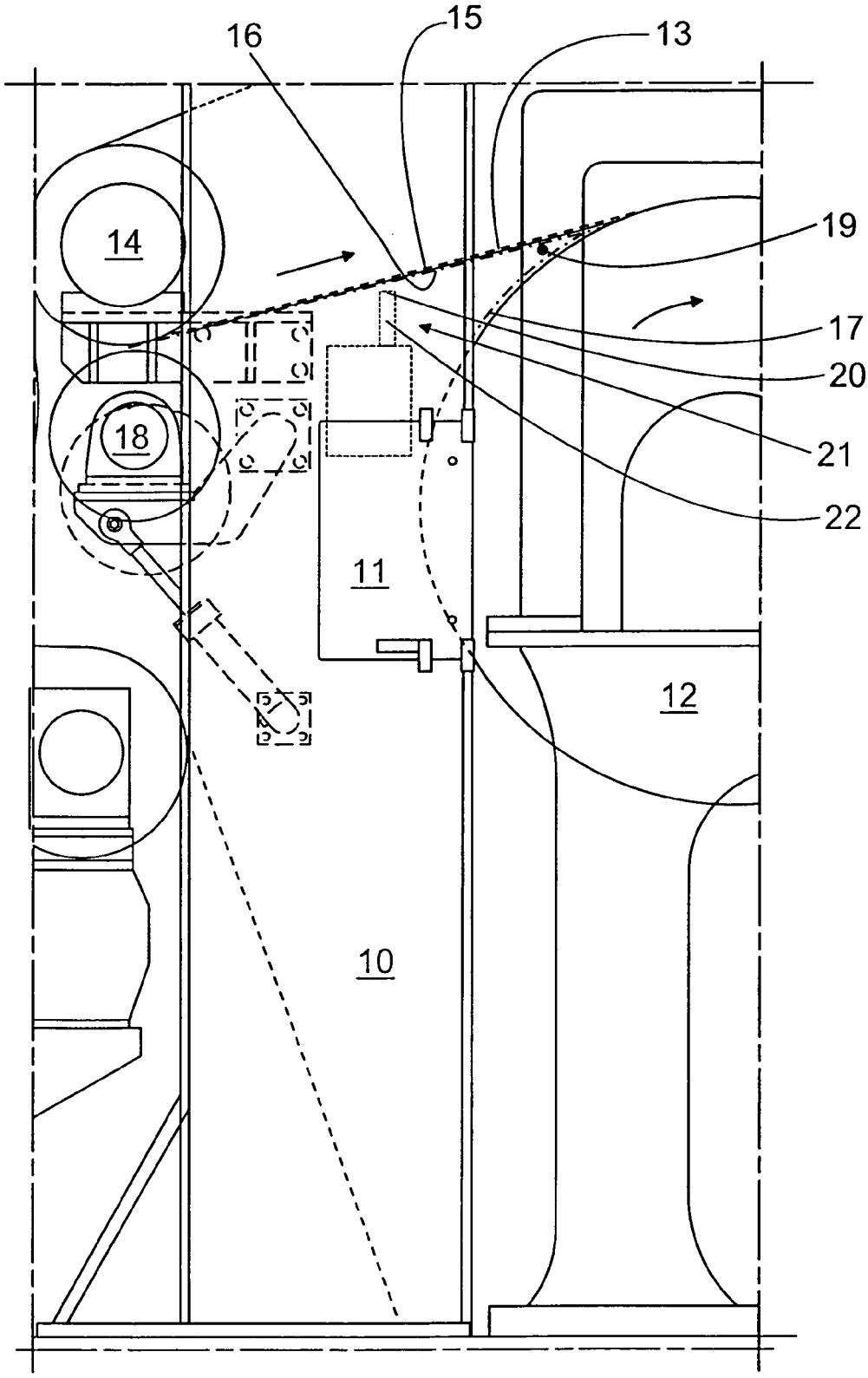
FIG. 1 shows the location of the device according to the invention, seen from the front side of the paper machine.

FIG. 1 shows the device according to the invention installed in a paper machine. Thanks to its versatility and efficiency, the device can also be installed in board machines and other similar machines. In this case, the device is in a position between the press section and the drying section of the paper machine. The device is attached to the frame beam 10 of the paper machine, i.e. to the inside of the paper machine. The location of the device is shown by the rectangle drawn with a broken line in FIG. 1. The construction of the device is dealt with in greater detail in connection with the other figures. The control case 11 of the device is correspondingly on the other side of the frame beam 10.

The drying section's first dryer cylinder 12, the fabric 13 running over the upper surface of which is shown by a broken line, is partly visible at the right-hand edge of FIG. 1. The fabric 13, which in practice is usually a drying wire, is guided onto the drying cylinder 12 with the aid of a lead roll 14. In the position shown, the lead roll 14 is the drying section roll that is closest to the press section. When web threading is commenced, the web threading tail is guided from the press section to the lead roll to the under surface of the drying wire in a manner that is, as such, known. The web threading tail travels with the drying wire to the first dryer cylinder, from which the web threading tail is run down, for example, to a pulper (not shown). Once the movement of the web threading tail has settled, the web threading tail is moved in the cross-machine direction of the paper machine, i.e. in this case towards the front side. The lateral transfer is used to lead the web threading tail to the next web threading device.

In the position shown, the first web threading device of the drying section comprises two ropeways 16 and 17, which form a rope throat 19 to the first dryer cylinder 12. The ropeways shown and the other ropeways related to them then carry the web threading tail through the entire drying section. The first ropeway 16 is guided through the lead roll 14 to the dryer cylinder 12. Correspondingly, the second ropeway 17 runs through the dryer cylinder 12. The construction and operation of the ropeways are, as such, conventional, so that they are not depicted here in greater detail. In addition, against the lead roll 14 there is an auxiliary roll 18, at least the front-side end of which is lowered during web threading away from the lead roll 14. This is shown by a broken line in FIG. 1. The rope throat 19 is formed close to the point of contact of the drying wire 13 and the dryer cylinder 12, so that a relatively small lateral transfer (FIG. 3) of the web threading tail is required. Besides the web threading device formed by the ropes, it is also possible to use, for example, web threading zones (not shown) formed in the end parts of the rolls or dryer cylinders. The web threading zones are outside the fabric and their operation is usually based on pressure zones.

Thus, in the method, a devices is used, which is moved close to the fabric and by means of which the web threading tail is detached from the surface of the fabric. The device and its operation are depicted in greater detail with reference to the figures. The device is also used to move the web threading tail laterally, relative to its direction of travel, to the following web threading device. Finally, the device is moved away from the vicinity of the web threading tail. According to the invention, the transfer of the web threading tail in the cross direction of the paper machine takes place mechanically by pushing. The imprecise and often ineffective blasts of the state of the art are then avoided. In addition, the web threading tail is detached from the surface of the fabric in connection with the pushing. Web threading is then accelerated compared to known methods. At the same time, the stages of the web threading become clear and follow each other, which helps to ensure the success of the web threading. The success of the web threading is also ensured by pushing the web threading tail laterally essentially linearly. This interferes as little as possible with the travel of the web threading tail, while pushing corresponds to the well-proven method of manual transfer.

According to the method, pushing the web threading tail takes place in three stages, a device equipped with a transfer member being used for pushing. In the first stage, the device is moved close to the fabric, after which in the second stage the transfer member is moved close to the fabric. In the third stage, the transfer member is used to push the web threading tail laterally. The stages in question are clear while the actual pushing is rapid and precise. The movement of the transfer member that pushes the web threading tail is preferably arranged to be linear, so that at the same time both the linear pushing of the web threading tail is realized and the construction of the device can be made simple.

Figure 3:
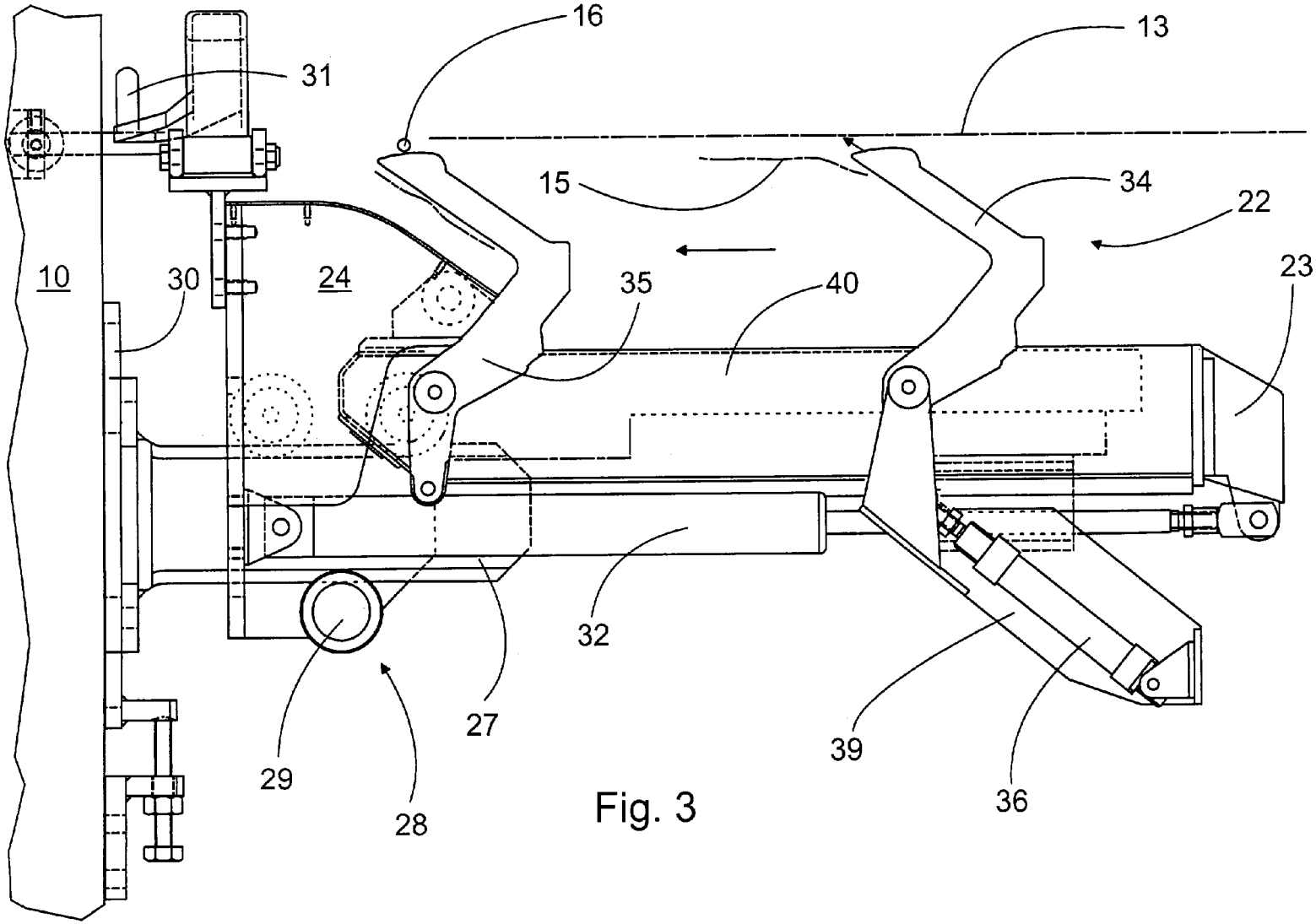
FIG. 3 shows the device of FIG. 2 in the operating position.

The actual device according to the invention is intended to be located in connection with the fabric that transports the web threading tail. According to the method, the device is used to detach the web threading tail from the surface of the fabric and to transfer the web threading tail laterally relative to its direction of travel, to the following web threading device. For this purpose, the device includes a blower device 20 for detaching the web threading tail 15 and a transfer device 21 for transferring the detached web threading tail 15. According to the invention, the transfer device 21 comprises a transfer member 22 that can be moved essentially in the cross direction of the paper machine. In addition, the transfer device is arranged to mechanically push the web threading tail 15 (FIG. 3). Thus, the web threading is more certain and faster than before. A blower device 20 is preferably also arranged in the transfer member 22, which will further simplify the construction and operation of the device. The construction of the transfer member is dealt with later in greater detail.

Figure 2:
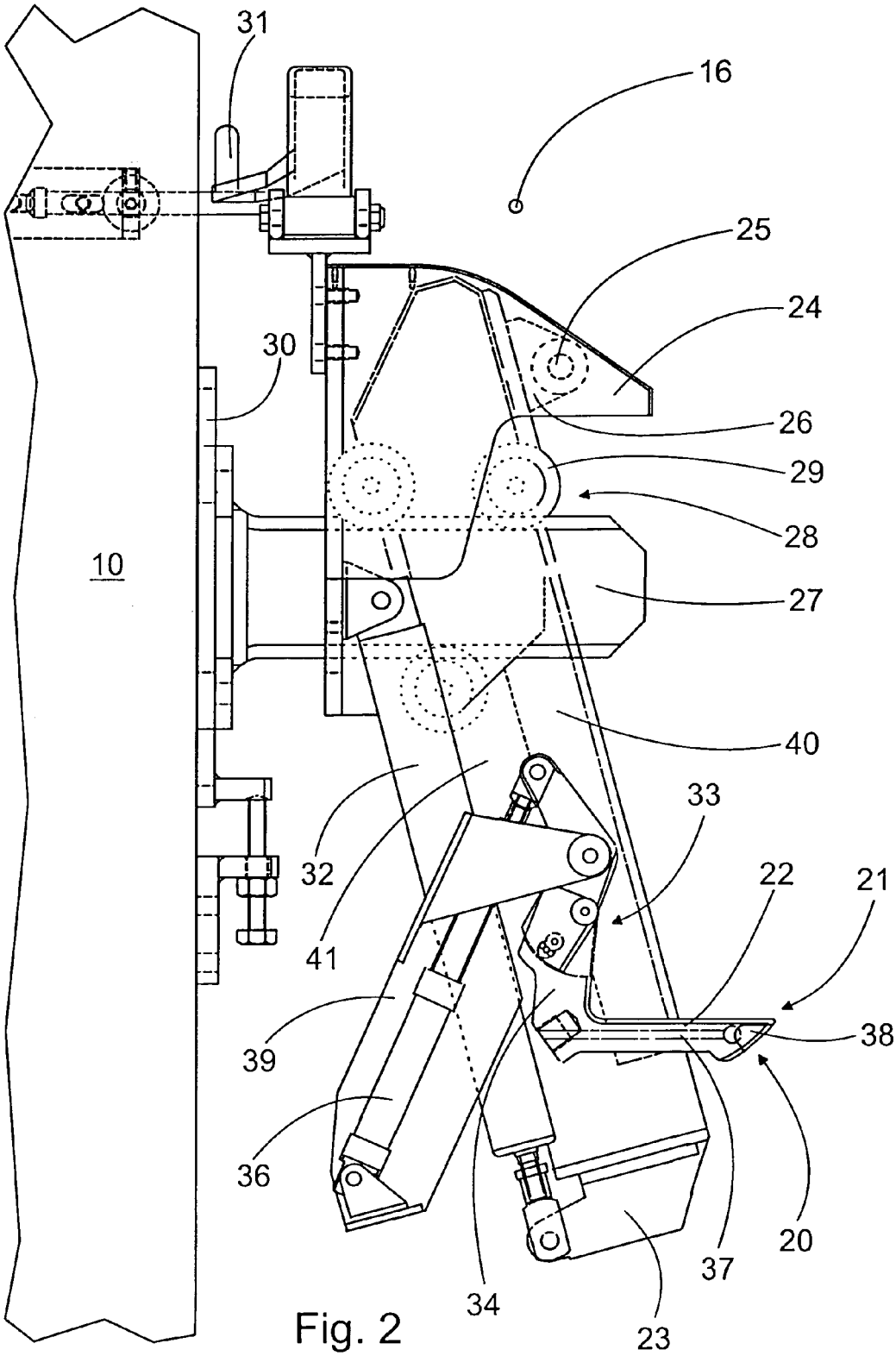
FIG. 2 shows the device according to the invention in the rest position, seen facing the machine direction.

FIG. 2 shows the device according to the invention in the rest position, seen facing the machine direction. FIG. 3 shows the same device in the operating position. In order to create a natural transfer, the transfer member 22 is arranged on a support arm 23 that moves linearly. In addition, the support arm 23 is supported on the frame construction 10 of the paper machine in a way that allows it to be rotated. The device can thus be turned away from the vicinity of the fabric. At the same time, only sloping surfaces remain in the structure of the device, so that little loose material will collect on top of the device.

In this application, the support of the support arm 23 comprises a frame piece 24, with a pivot pin 25 fitted to it for the support arm 23. From beneath, the frame piece 24 is an open sheet-metal case, which helps to protect the support arm 23 and the rest of the structure of the device. The pivot pin 25 is attached to lugs 26 in the support arm 23, thus permitting the support arm 23 to move relative to the frame piece 24. The device also includes a carrier 27 attached to the frame structure of the paper machine. In addition to this, there are guide members 28 in the frame piece 24, corresponding to the carrier 27, for positioning the support arm 24 in the cross direction of the paper machine. In the embodiment shown, the carrier 27 is a protruding beam of bevelled steel bar, the upper and lower bevels of which support grooved rollers 29 fitted to the frame piece 24. The construction in question is extremely rugged, but also easy to move. In addition, the structure remains very clean, with the guide rollers protected inside the frame piece.

Figure 5:
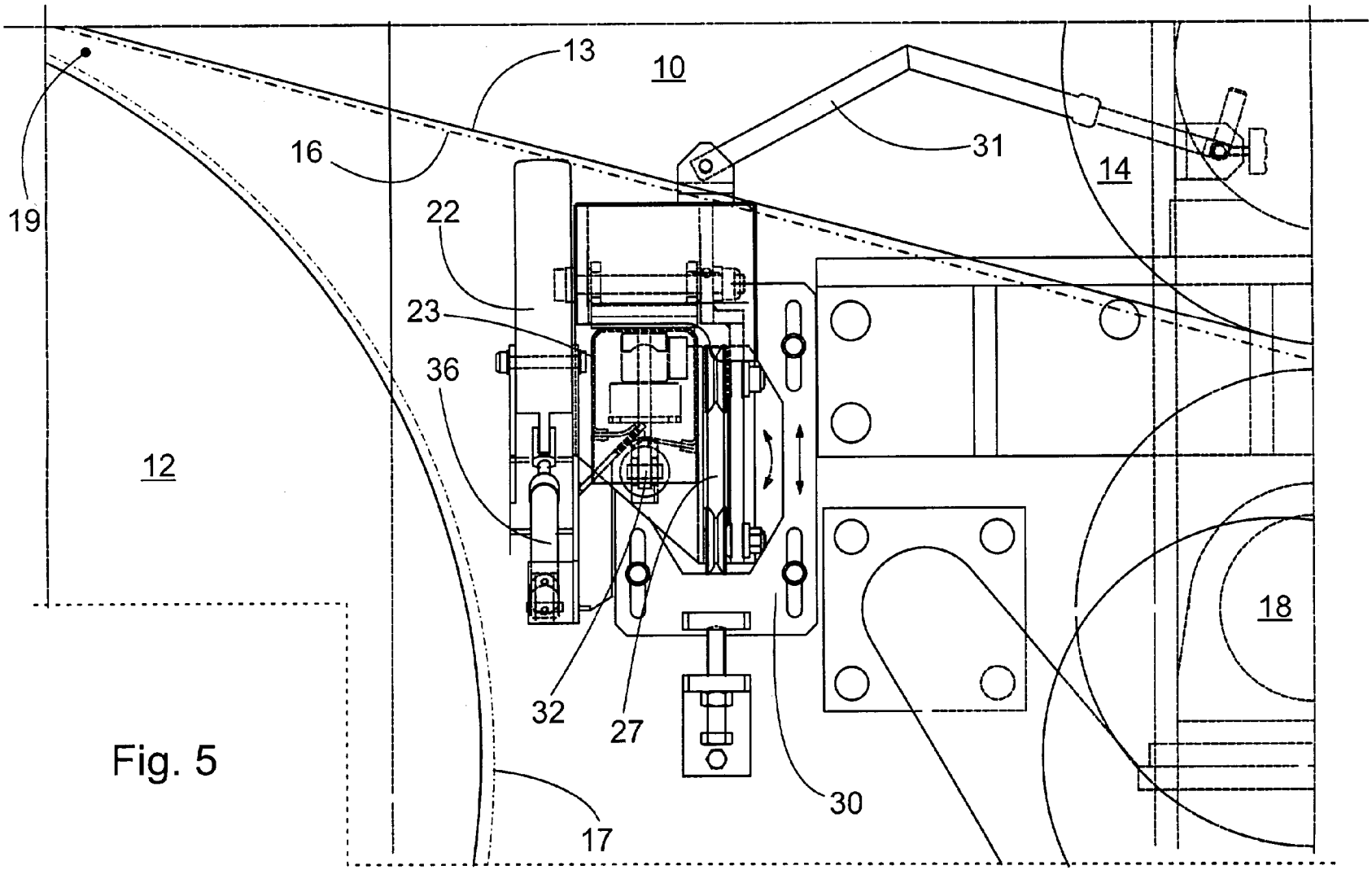
FIG. 5 shows the device of FIG. 3, seen from the front side.

The device is installed at the location planned for it on the frame beam. For fine setting, the baseplate 30 of the carrier 27 can be adjusted vertically (FIG. 5). Correspondingly, the carrier 27 itself is arranged to be able to be rotated relative to its centerline, by means of suitable attachments. Once the settings are correct, the carrier is secured to be immovable during operation. The position of the frame piece, however, can be altered, even during operation. For positioning, a lockable adjustment arm 31 extends from the frame piece 24 to the side of the frame beam 10, from where it can be operated safely. By releasing the adjustment arm, the frame piece and thus the entire support arm can be moved in the cross direction of the paper machine. The transfer member can then be adjusted to the correct position. This embodiment has a potential frame-piece adjustment of about 100 mm.

Set to the correct position, the device is always ready for use, provided the other conditions remain substantially unchanged. All the operations of the device are preferably implemented using compressed air, which is easy and safe to use. In order to be able to turn the support arm from the rest position to the operating position, the device includes a pneumatic cylinder 32, which is attached between the frame piece 24 and the opposite end of the support arm 23. In FIG. 3, the support arm 23 is shown raised to the operating position.

To achieve the most reliable operation possible, the transfer member is also supported on the support arm in such a way that it can be rotated, which particularly aids the operation of the blower device. Thus the transfer device also has rest and operating positions. In FIG. 2, the transfer device 22 is in the rest position, and correspondingly in FIG. 3 in the operating position. FIG. 2 also shows the adjustment construction 33 of the transfer member 22, by means of which the position of the first arm 35 of the basically V-shaped transfer member 22 can be altered. The angle of the second arm 34 of the transfer member relative to the fabric 13 and the web threading tail 15 can then be adjusted as desired, while the turning movement of the transfer member remains the same. Thus the transfer member can be operated simply using the pneumatic cylinder 36. The figures do not show the pneumatic hoses or other equipment relating to the control of the device. The same reference numbers are used for components that are operationally similar.

According to the invention, a blower device 20 is arranged in the transfer member 22, which simplified the construction of the device and ensures the pushing effect. FIG. 2 shows the construction of the blower device 20 in greater detail. In this case, the second arm 34, i.e. that closest to the fabric, of the transfer member 22 is arranged to be hollow, in order to form the blower device 20. In practice, a borehole 37 is machined in the arm 34, to the first end of which a compressed air connection (not shown) is connected. Correspondingly, the other end of the borehole opens at the end of the arm 34 of the transfer member 22, in which there is a suitable nozzle 38 for creating a detaching blast. The nozzle 38 can also be turned relative to the arm 34, so that the direction of the blast can be set as desired. This further assists the detaching of the web threading tail from the surface of the fabric.

Figure 6:
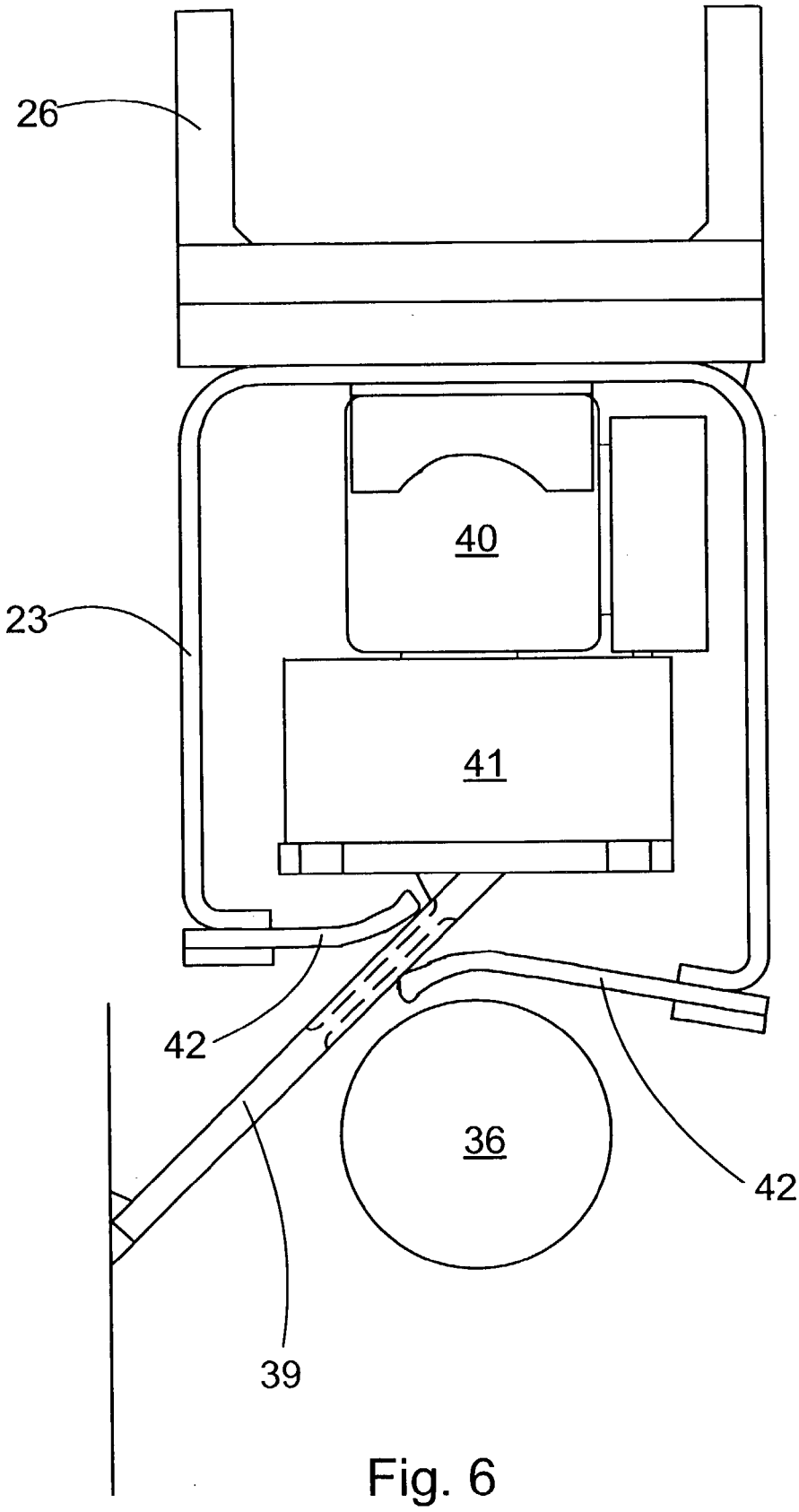
FIG. 6 shows the support arm of the frame structure of the device of FIG. 5.

To simplify and lighten the construction of the device, the transfer member 22 with the pneumatic cylinder 36 is fitted to an auxiliary frame 39 forming part of the device. In addition, a cylinder 40 without a piston rod, to the slide 41 of which the said auxiliary frame 39 is attached, is used as the operating device of the transfer member 22. This avoids separate guides for the transfer member and at the same time exploits the load-bearing capacity of the cylinder 40 without a piston rod. In addition, the cylinder 40 is well protected inside the support arm 23. FIG. 6 shows a simplified view of the location of the cylinder 40 without a piston rod inside the support arm 23. The figure also shows the attachment of the auxiliary frame 39 to the slide 41 and also rubbing, but flexible seals 42, which protect the attachment. One preferred cylinder without a piston rod is the cylinder known under the product name ORIGA, in which the slide attached to the piston is supported by the frame of the cylinder. The cylinder can then be used directly as a guide.

In practice, the transfer member is preferably made of a plastic material, such as PTFE plastic. The friction between the web threading tail and the transfer member will then be the least possible, which will assist the success of the web threading. In addition, the plastic is highly resistant to variations in temperature. To minimize disturbances, the second arm 34 of the transfer device 22 is also given a curved shape (FIG. 5), so that the travel of the web threading tail will be disturbed as little as possible. The other structures of the device are preferably made from stainless steel.

Figure 4:
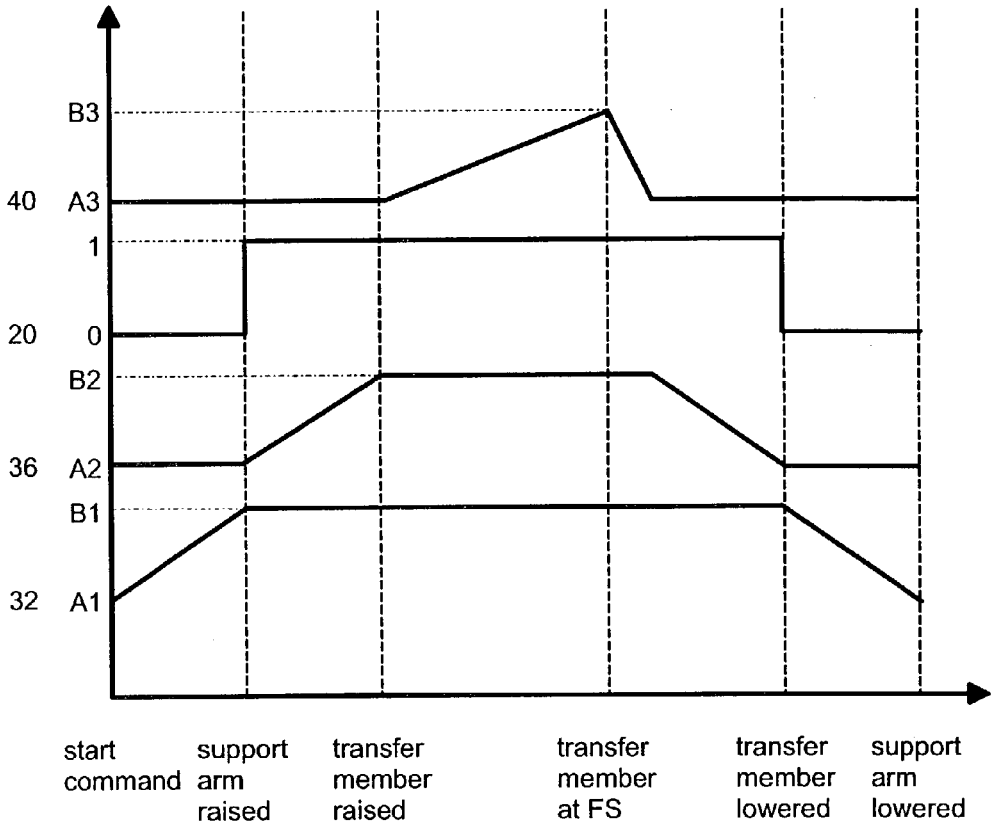
FIG. 4 shows a sequence diagram of the device according to the invention.

The following describes the operation of the device, with particular reference to FIGS. 3 and 4. The device is controlled from a control box at the frame beam 10 or from the dryer group control room. The control commands are electrical and are used to control magnetic valves. If necessary, limit switches, control logic, and indicator lights are used. However, the device is designed in such a way that the consecutive stages can be performed with the aid of simple control and operating elements. Thus, the total device is simple. Generally, when web threading is commenced, the support arm 23 is lowered in the rest position. The start command is then used to make the first cylinder 32 raise the support arm 23 to the upper position. At the end of the work stroke, it is preferable to receive some detectable information that the support arm is in the operating position. It is then possible to commence web threading, if this is otherwise possible.

Next, the continue command is given, when the second cylinder 36 will turn the transfer member 22 from the rest position to the operating position. At the same time, the blower starts and begins to detach the web threading tail 15 from the surface of the fabric 13. Once the transfer member 22 is in the operating position, the third cylinder 40 begins to move the transfer member 22 towards the front side, i.e. from right to left in FIG. 3. At the same time, the web threading tail 15, which has been detached by the blast, nevertheless continues to move in the longitudinal direction (FIG. 3) to support the arm 34. The movement of the transfer device 22 continues to the end, unless the reverse command is given. By means of the reverse command, the transfer member 22 returns to the end of the support art 23 and drops to the rest position. At the same time the blowing stops. Without the reverse command, the transfer member 22 will continues its movement to the end, after which detectable information will be given. At this stage, the web threading tail has moved to the sphere of influence of the next web threading device, so that the device has carried out its task. By giving the terminate command, the transfer member 22 moves rapidly to the back side end of the support arm 23 and drops to the rest position. If the web threading fails, the next attempt can be made even immediately after this stage. If the repeat is unnecessary, the support arm 23 is lowered to the rest position. Thus, the stages of the operation of the device can be controlled manually or even preprogrammed. The stages are clear entireties, which can be repeated and implemented as the situation demands. In the example embodiment, the movement of the transfer member 22 is about 350 mm. In FIG. 4, the symbols A and B refer to the end positions of the various cylinders 32, 36, and 40. Correspondingly, in connection with the blower device 20, 0 refers to the blast being shut off and 1 to its being opened.

The method according to the invention is easy to implement and can be applied in various positions. Correspondingly, the device according to the invention is simple and reliable in operation. The combination of the blower device with the transfer member achieves a very powerful device for transferring a web threading tail laterally. During the mechanical and essentially linear pushing, the web threading tail is all the time controlled by the device, without, however, interfering with the travel of the web threading tail.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method in leading a web threading tail in a paper machine having a frame structure, in which method a device including a transfer member attached to the frame structure of the paper machine is used, said device mechanically transferring the web threading tail relative to the direction of travel of the web threading tail to the following web threading device, said web threading tail being transported on a fabric, characterized in that before the transfer of the web threading tail the device is moved close to the fabric transporting the web threading tail and by which the web threading tail is detached from the surface of the fabric, and the web threading tail is transferred in the cross direction of the paper machine by pushing said tail with the transfer member, said transfer member having a linear movement in a lateral direction, after which the device is moved away from the vicinity of the web threading tail.

2. A method according to claim 1, characterized in that the web threading tail is detached from the surface of the fabric by blowing.

3. A method according to claim 1, characterized in that said transferring is done in three stages:

i) said device including said transfer member is first moved close to the fabric;

ii) the transfer member is moved close to the fabric; and iii) the web threading tail is then pushed laterally using said transfer member.

* * * * *